US008424588B2

(12) United States Patent
Hirano et al.

(10) Patent No.: US 8,424,588 B2
(45) Date of Patent: Apr. 23, 2013

(54) CASTING DIE

(75) Inventors: Masao Hirano, Kitanagoya (JP); Yoshitaka Horibe, Kitanagoya (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 13/389,372

(22) PCT Filed: Jun. 24, 2010

(86) PCT No.: PCT/JP2010/060719

§ 371 (c)(1), (2), (4) Date: Feb. 7, 2012

(87) PCT Pub. No.: WO2011/018922

PCT Pub. Date: Feb. 17, 2011

(65) Prior Publication Data

US 2012/0132388 A1 May 31, 2012

(30) Foreign Application Priority Data

Aug. 8, 2009 (JP) ..... 2009-185341
Nov. 27, 2009 (JP) ..... 2009-269666

(51) Int. Cl.
*B22D 17/20* (2006.01)

(52) U.S. Cl.
USPC ..... 164/312; 164/113

(58) Field of Classification Search ..... 164/113, 164/119, 120, 306–318
See application file for complete search history.

(56) References Cited

U.S. PATENT DOCUMENTS 6,896,033 B2 5/2005 Yamamura et al.
2005/0126742 A1 6/2005 Yamamura et al.

FOREIGN PATENT DOCUMENTS

JP 05-261487 10/1993
JP 05-329590 12/1993
JP 07-246450 9/1995
JP 2002-113558 4/2002
JP 2008-126248 6/2008

OTHER PUBLICATIONS

International Search Report, Aug. 25, 2010, issued in PCT/JP2010/060719, 1 page.
Chinese Office Action dated Nov. 28, 2012; Appln. No. JP 1027292; 7 pages.

*Primary Examiner* — Kuang Lin
(74) *Attorney, Agent, or Firm* — Finnegan, Henderson, Farabow, Garrett & Dunner, L.L.P.

(57) ABSTRACT

The present invention provides a casting die that can achieve the improved fluidity of molten metal and the improved ease release of castings from die. The casting die 10 comprises area of dimples D where a plurality of first dimples are formed in semispherical shape on the surface of the cavity 11 with no particular indication of direction and in a dispersed manner and where the ratio of communication is 80% or more, which ratio of communication is defined by the ratio of the number of the first dimples 12 that constitute the bound dimples 12*b*, which each comprise one or more of the dimples, to the total number of the first dimples 12. So, in the area of dimples D a number of bound dimples 12*b* that work as short flow-channels that have no particular indication of direction are randomly formed, thus improving the fluidity of the molten metal.

15 Claims, 5 Drawing Sheets

(A) overall view (B) enlarged view of part (A)

(C) enlarged view of part (B)

| A. area ratio | B. ratio of communication | CCD photo | photo by binarization processing | C. results of evaluation |
|---|---|---|---|---|
| 0% | 0% |  | | × |
| 28% | 48% (40 Nos. / 84 Nos.) |  |  | × |
| 50% | 80% (120 Nos./ 150 Nos.) |  |  | ○ |
| 71% | 98% (193 Nos./ 197 Nos.) |  |  | ○ |
| 86% | 100% |  |  | ○ |
| 97% | 100% |  |  | △ |

CASTING DIE

FIELD OF INVENTION

This invention relates to a casting die such as used for die casting.

BACKGROUND OF INVENTION

Conventionally a method that uses a die casting is used to manufacture the parts of an automobile such as a cylinder head or manifold, etc., from non-ferrous metal such as aluminum, etc. For the die casting method including gravity die casting, etc that uses die made of such as metal, thermet, etc, various attempts have been made to improve the fluidity of molten metal because if the flow of the molten metal (metal flow) is not carried out smoothly, defects such as minute shrinkage cavities or flow marks are likely to occur on the castings. To improve the fluidity of the molten metal one method is to rectify the flow of the molten metal by forming on the surface of the metal die (surface of cavity) concavo-convex shapes on the surface of a cavity, thereby enabling the molten metal flow on the overall surface of the cavity. A method to improve the fluidity of the molten metal by forming concavo-convex shapes on the surface of the cavity is shown, for example, in Patent Document 1. It discloses a casting die wherein the molten metal is poured uniformly in all parts of the cavity by having square shaped concavities and convexities continuously spread side-by-side over the surface of the cavity of the die, by alternately forming the parts that have high and low flow resistances and by having one side of the square shaped concavities and one side of the square shaped convexities inclined toward the direction from which the molten metal is poured.

Patent Document: JP H07-246450

SUMMARY OF INVENTION

Problem to be Solved by Invention

In the above example, the concavo-convex shapes of the die are formed by surface texturing that corrodes the surface of the cavity by a corrosive liquid such as nitric acid solution and that produces the concavities and convexities on the surface of the cavity or by electrical discharge machining. However, these methods have problems in that the scope of the surface of the cavity that is treated is limited and a sufficient fluidity of the molten metal cannot be obtained if the die has a cavity of a complex shape. Also, in a method of surface texturing, there is a problem in that a sufficient fluidity of the molten metal can not be obtained because it can not produce concavo-convex shapes, of which sizes, depths or shapes are highly controlled in the production.

Also, the casting die has a problem in that because the concavo-convex shapes that are formed have angular edges, such shapes cause the release of castings from the die to be less easy (ease of release).

Also, if the concavo-convex shapes are inclined in one direction, a parting agent that is applied to the surface of the cavity and that facilitates the release of the castings from the die is prevented from being stored uniformly on the surface of the cavity, thus reducing the ease of release.

In view of the above problems, the purpose of the present invention is to provide a casting die that can achieve an improved fluidity of the molten metal, that has improved ease of release and that is less likely to have a penetration and has a superior heat resistance.

Means to Solve Problems

This invention is directed to a casting die that can achieve the above-mentioned purpose. The first invention uses a technical means wherein the casting die comprises an area of dimples where a plurality of first dimples are formed at least on a part of surface of the cavity and/or at least on a part of a runner, having no particular indication of direction and formed in a dispersed manner, and where the first dimples are formed in shallow hemispherical shapes and the ratio of communication that is defined by the number of first dimples that communicate with the other one or more first dimples against the total number of the first dimples is 80% or more. The term the "area of dimples" refers to the area that is formed by the outermost circumference that surrounds the group of first dimples.

According to the first invention, the casting die comprises the area of dimples where a plurality of first dimples are formed at least a part of surface of the cavity and/or at least on a part of a runner, having no particular indication of direction and in a dispersed manner and the ratio of communication is 80% or more. So, in the area of dimples a number of short flow-channels that have no particular indication of direction are randomly formed by a few numbers of the first dimples being bound together.

The molten metal that flows through the first dimples and that enters the flow-channels randomly changes the directions of the flow so that the molten metal is uniformly dispersed and thus the fluidity of the molten metal can be improved. With the fluidity of the molten metal thus improved, the castings have fewer defects that accompany the casting such as pinholes caused by the mixing-in of air, cold shuts, flow marks, etc.

Further, the first dimples are formed in hemispherical shapes such that the parting agent that is applied to the surface of the cavity when casting is performed can more easily be stored on the surface of the cavity. Also, by forming the dimples in hemispherical shapes that have no pointed corners and that are different from the shapes of the dimples that are formed by surface texturing, the castings produced will less likely suffer scoring, etc., when it is released from the die. Thus the castings will be protected from damage because it can easily be released from the die.

The second invention uses a technical means wherein the first dimples have openings with diameters of 60-500 μm wide and depths of 4-30 μm and wherein the area-ratio, which is the ratio of the area of the first dimples to the area of dimples, is 50-90%.

The first dimples are preferably formed as shallow dimples of hemispherical shapes that have a ratio of 10 or more, where the ratio refers to the ratio of the diameters of the openings of the dimples to their depths. So, as is stated in second invention, the first dimples preferably have openings with diameters of 60-500 μm wide and depths of 4-30 μm and also the ratio of area of the first dimples to the area of dimples (area-ratio) is preferably 50-90%. Further, as stated third invention, the area-ratio is more preferably 71 to 86%. As is stated in the present invention (second invention), to have the ratio of communication increased to 80% or more the area-ratio is preferably kept 50% or more. But if the area-ratio is increased to above 90%, the first dimples overlap each other so that the shape of each of the first dimples cannot form a hemisphere. Thus because of the shape of the dimple, the parting agent is less likely remain in the dimple and thus the dimple had an inferior property in the ease of release. Moreover, the first dimple is likely to have angular edges such that the castings are likely to be accompanied with scorings when the castings are released from the die. So, the area-ratio is preferably 90% or less.

The fourth invention uses a technical means wherein second dimples have openings whose diameters are smaller than those of the first dimples and are formed in the area of dimples in such a way that the second dimples are intermingled with the first dimples.

According to the fourth invention, the second dimples have openings whose diameters are smaller than those of the first dimples and are formed in the area of dimples in such a way that the second dimples are intermingled with the first dimples. So, even in the part in the area of dimples, in which part the first dimples are not formed, traces of treatment that are caused by machining the surface of cavities can be removed and the surface can be made showing no indication of direction. As a result, the first dimples and the second dimples can be uniformly dispersed without any indication of direction on the surface of the cavity. So, the first dimples and the second dimples thus formed can improve the fluidity of the molten metal by conserving the heat of the molten metal, for example, for the following reasons:

(1) the surface area of the die that contacts the molten metal increases. So the heat of the molten metal is more easily transferred to the die and the die is less likely to lose heat; and (2) the airgap-layers that are formed in the larger concavities (the first dimples) of the concavities and convexities work to not allow the temperature of the molten metal to drop.

Also, because the part of the area of dimples where the first dimples are not formed is more likely to retain the parting agent, the peeling effect can be increased.

The fifth invention uses a technical means wherein the second dimples are formed in hemispherical shapes and have openings with diameters of 10-60 μm wide and depths of 1-7 μm.

The second dimples are formed so as to produce a surface having no particular indication of direction by removing the traces of treatment, etc., that were caused by machining, etc., from the surface of cavities, and so as to improve the fluidity of the molten metal. So, the surface roughness should not be increased more than necessary. For example, the surface of the cavity preferably should have a surface roughness Rz (the average roughness of ten points) that is about a few μm. By forming the second dimples as stated in fifth invention, the surface of the cavity will have no particular indication of direction after removing the traces of treatment, etc., that were caused by machining, etc., of the surface of the cavity and will have a tiny concavities and convexities that are suitable for improving the fluidity of the molten metal.

The sixth invention uses a technical means wherein the surface of the cavity is nitride-treated.

According to the sixth invention, the surface of the cavity is nitride-treated. So, the die has improved durability and a longer life.

The seventh invention uses a technical means wherein the area of dimples is provided in the runner.

According to the seventh invention, the area of dimples is provided in the runner so that the molten metal encounters less resistance when it passes through the runner to be subsequently poured into the cavity. So, the flow of the molten metal that is poured in the cavity is not disturbed. This also can improve the fluidity of the molten metal into the cavity.

The eighth invention uses a technical means wherein the area of dimples is provided at the bottom part of the surface of the cavity.

According to the eighth invention, the area of dimples is provided at the bottom part of the surface of the cavity, which bottom part the molten metal that is poured into the cavity constantly contacts. So, the fluidity of the molten metal can be more effectively improved.

The ninth invention uses a technical means wherein the area of dimples is provided on the parts of the wall of the surface of the cavity, which parts extend in the direction in which the die opens and closes (open-and-close direction).

The parts of the wall of the surface of the cavity, which parts extend in the open-and-close direction of the die, are likely to cause the parting agent to flow downward such that the castings are sometimes affected by a scoring at the part that contacts such parts of the wall. By providing the area of dimples on the parts of the wall of the surface of the cavity, as described in ninth invention, the above problem can be prevented from occurring.

The tenth invention uses a technical means wherein the area of dimples is provided on the convexities of the surface of the cavity.

The parting agent is likely to fall off the convexities of the surface of the cavity. So the castings are likely to be affected by penetration or scoring at the part that contacts the convexities of the surface of the cavity when the castings are released from the die. By providing the area of dimples on the convexities of the surface of the cavity, as described in tenth invention, the above problem can be prevented from occurring.

The twelfth invention uses a technical means wherein the area of dimples is provided on the concavities of the surface of the cavity.

The thirteenth invention uses a technical means wherein the concavities of the surface of the cavity are the dented corner parts of the surface of the cavity. The concavities of the surface of the cavity are the parts where stresses are concentrated and where conventionally heat cracks are likely to occur, particularly in the dented corner parts of the surface of the cavity. By providing the area of dimples in the concavities of the surface of the cavity, as described in twelfth invention, the dimples are formed in the concavities, particularly in the dented corner parts of the surface of the cavity. So, the dimples formed in the concavities of the surface of the cavity can disperse the stresses and thus can prevent heat cracks from occurring. The shape of the dented corner part for example, in FIG. 5(C), where the area of dimples is provided in the concavities of the surface of the cavity, is shown, but the shape of the dented corner part of the present invention is not limited to this shape.

The fourteenth invention uses a technical means wherein the first dimples are formed by blasting treatment.

According to the fourteenth invention, if the first dimples are formed by blasting treatment, the surface of the cavity of the die can be formed to have a complex shape. Also, by selecting suitable particles to be sprayed and the conditions for spraying for blasting treatment, the first dimples can be formed so that they have required dimensions, area-ratio, and ratio of communication.

The eleventh invention uses a technical means wherein the convexities of the surface of the cavity are the protruded corner parts of the surface of the cavity. As stated above, by forming the area of dimples in the convexity of the surface of the cavity by blasting treatment, the surface (protruded corner part) is either removed or plastically deformed such that the protruded corner part is beveled. The parting agent is likely to fall off the convexities, particularly, the protruded corner part, of the surface of the cavity. So the castings are likely to be affected by penetration or scoring at the part that contacts the convexities of the surface of the cavity when the castings are parted from the die. Also, the convexity of the surface of the cavity is likely to be the starting point of a heat crack. By the protruded corner part being beveled by blasting treatment, the parting agent is more easily attached to it and has a shape that can disperse the stresses, thus preventing the heat cracks from occurring. For example, FIG. 5(B) shows the protruded corner part of the surface of the cavity. But the shape of the protruded corner part of the present invention is not limited to this one.

The fifteenth invention uses a technical means wherein if the second dimples are formed in the area of dimples, the second dimples are formed by the blasting treatment.

According to the fifteenth invention, if the second dimples are formed by blasting treatment, the surface of the cavity can be formed to have a complex shape. Also, by selecting suitable particles to be sprayed and the conditions for spraying for blasting treatment, the second dimples can be formed so that they have required dimensions, area-ratio, and ratio of communication.

As is clear from the above explanation, the conventional casting die is affected and damaged by scorings or heat cracks after it produces more than about 50,000 pieces of castings and needs repairs, which sometimes involve retreatment using nitride. The present casting die, which is treated by the blasting treatment of the present invention, also has dimples formed on the protruded corner parts of the surface of the cavity and on the dented corner parts of the surface of the cavity such that the surface of the cavity is beveled, enabling the stresses to be dispersed. Also, the parting agent, which conventionally is hard to attach to the walls of the surface of the cavity or to the protruded corner parts, can easily be attached, whereby the capacity of the surface of the cavity to hold the parting agent can be increased. Thus the casting die of the present invention can have excellent durability that can maintain improved fluidity of the molten metal even after it produces more than 100,000 pieces of castings, without having any scoring or heat crack or needing to be treated with nitride.

BRIEF DESCRIPTION OF DRAWINGS

FIG. 1(A) shows a cross section of one part of the casting die that is opened.

FIG. 1(B) shows an enlarged schematic plan view of one part of the area of dimples provided on the bottom part of the surface of the cavity as seen from the direction of X of FIG. 1(A).

FIG. 1(C) is a cross-sectional view as seen from line A-A of FIG. 1(B).

FIG. 4(A) is a schematic plan view as seen from the opening of the casting die.

FIG. 4(B) is a cross-sectional view of the area of dimples as seen from line B-B of FIG. 4(A).

FIG. 5(A) is an overall view of the casting die where the area of dimples is provided.

FIG. 5(B) is an enlarged view of part A of FIG. 5(A).

FIG. 5(C) is an enlarged view of part B of FIG. 5(A).

EMBODIMENT OF CARRYING OUT INVENTION

Figure 1:
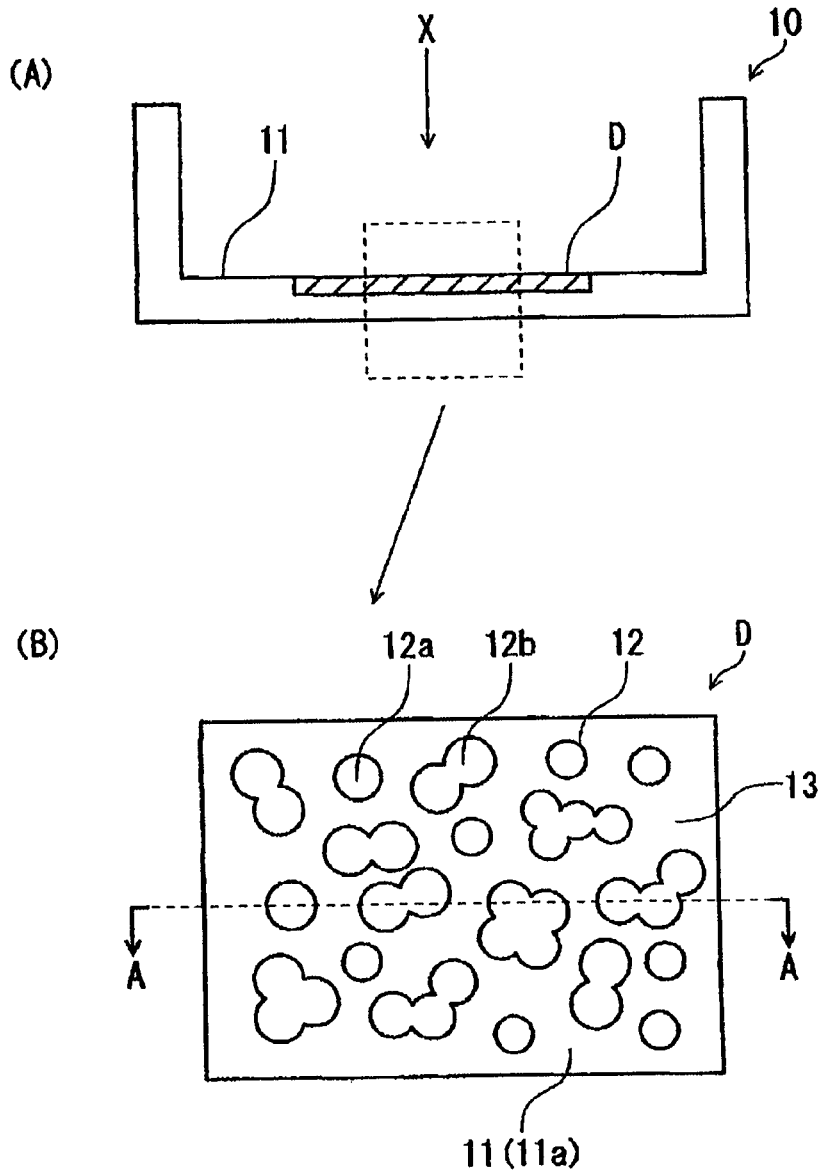
FIG. 1 illustrates the structure of the casting die of one embodiment of the present invention.

The casting die of the present invention is explained by referring to the drawings, where the casting die is provided with the first dimples on the bottom part of the surface of the cavity.

The casting die of the present embodiment is one used for casting an aluminum alloy, etc. FIG. 1 shows only one part of the casting die 10 that is opened. As shown in FIG. 1, the die 10 has an area of dimples D on the bottom part 11*a* of the cavity 11 which area of dimples D consists of the first dimples 12 and the second dimples 13. The area of dimples D refers to the area that is formed by the outermost line that surrounds the first dimples 12. In the present embodiment, the area of dimples D is formed on most of the bottom part 11*a*.

The first dimples 12 are formed in shallow hemispherical shapes and are uniformly dispersed without any indication of direction in the area of dimples D. In the area of dimples D, single dimples 12*a* that are the first dimples of the hemispherical shapes and the bound dimples 12*b* that consist of a plurality of the first dimples that are bound and that form short flow channels are intermingled.

Given the number of the single first dimples 12*a* is A and the number of the first dimples that constitute the bound dimples 12*b* is B, the ratio of communication is defined by B/(A+B), namely, the ratio of the number of the first dimples that constitute the bound dimples 12*b*, which each comprise one or more number of the dimples, to the total number of the first dimples 12.

Figure 2:
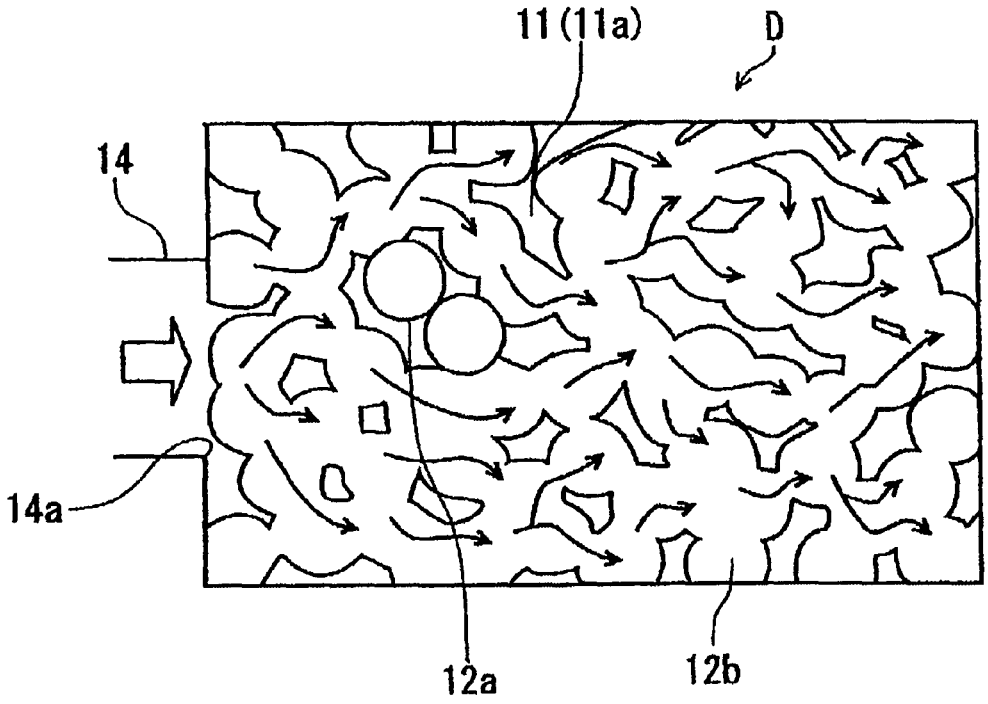
FIG. 2 is a schematic illustration of the improved fluidity of the molten metal in the area of dimples.

By the first dimples 12 being formed to be uniformly dispersed without any indication of direction on the area of dimples D of the die 10 so that the ratio of communication as above defined is 80% or more, the bound dimples 12*b* that form a number of short flow-channels that have no particular indication of direction are randomly formed. As is schematically shown in FIG. 2, most of the molten metal that is poured into the cavity through an inlet 14*a* after passing the runner 14, enters the bound dimples 12*b*. The molten metal that enters the bound dimples 12*b* randomly changes the direction of flow as shown by the arrows in FIG. 2. So, the molten metal can be uniformly spread and dispersed in the cavity such that the fluidity of the molten metal can be improved, reducing defects in castings such as pinholes caused by the mixing-in of air, cold shuts, flow marks, etc.

The first dimples 12 are formed in hemispherical shapes so that the parting agent that is applied to the surface of the cavity when casting is performed can more easily be stored on the surface of the cavity. Also, by forming the dimples to have a hemispherical shapes that have no pointed corners, unlike the shape of the dimples that are formed by surface texturing, the castings obtained will less likely be damaged from scoring, etc., and also can be easily parted from the die.

To have the above effect be more conspicuous, the first dimples 12 are preferably formed as shallow dimples of hemispherical shape, which dimples have openings where the ratio of the diameters to the depth is 10 or more. So, the first dimples should have openings with diameters of 60-500 μm wide and depths of 4-30 μm and also the ratio of area of the first dimples to the area of dimples D is preferably 50-90%.

Also, to have the ratio of communication increased to 80% or more the area-ratio is preferably kept above 50%. But if the area-ratio is increased to 90% or more, most of the first dimples 12 overlap each other so that the shape of each of the first dimples cannot form a hemisphere. Thus because of the shape of the dimple, the parting agent is less likely to remain in the dimple and thus the dimple has an inferior property in the release of castings (ease of release). Moreover, the first dimple is likely to have angular edges such that the castings are apt to be accompanied with scorings when the castings are released from the die. So, the area-ratio is preferably 90% or less.

The second dimples 13 that have openings whose diameters are smaller than those of the first dimples are formed in the area of dimples D in such a way that the second dimples are intermingled with the first dimples. In the present embodiment, as shown in FIG. 1(C), the second dimples 13 are formed in the part of the area of dimples D where the first dimples are not formed.

The second dimples 13 are formed in such a way that even the part in the area of dimples D where the first dimples are not formed can have the traces of treatment caused by machining the surface of cavities be removed and can have the surface show no indication of direction. As a result the first dimples and the second dimples can be uniformly dispersed without any indication of direction on the surface of the cavity.

So, the concavities and convexities thus formed by the first dimples 12 and the second dimples 13 can improve the fluidity of the molten metal by conserving the heat of the molten metal, for example, for the following reasons:

(1) the surface-area of the die that contacts the molten metal increases. So the heat of the molten metal is more easily transferred to the die and the die is less likely to lose heat; and (2) the airgap-layers that are formed in the larger concavities (the first dimples 12) of the concavities and convexities work to not allow the temperature of the molten metal to drop.

Also, because the part of the area of dimples where the first dimples 12 are not formed is more likely to retain the parting agent, the peeling effect can be increased.

To have the above effect be more conspicuous, the surface roughness should not be increased more than necessary. For example, the second dimples 13 preferably should have a surface roughness Rz (the average roughness of ten points) that is about a few μm. By forming the second dimples 13 to have hemispherical shapes whose openings have diameters of 1-60 μm wide and depths of 0.1-7 μm, the surface of the cavity 11 will have no particular indication of direction after removing the traces of treatment, etc., that were caused by machining, etc., of the surface of the cavity and will have tiny concavities and convexities that are suitable for improving the fluidity of the molten metal.

Figure 3:
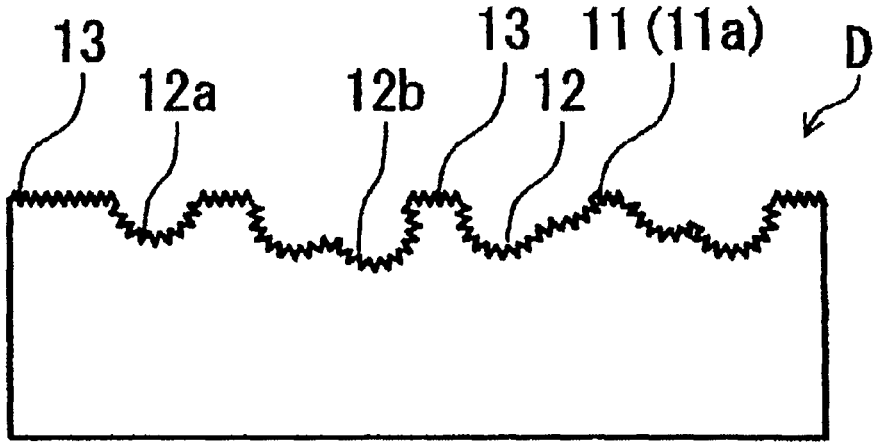
FIG. 3 is a cross-sectional view of the area of dimples that is modified in an alternative embodiment.

In the above embodiment, the second dimples 13 are formed in the part of the area of dimples D where first dimples 12 are not formed. But in an alternative embodiment, as shown in FIG. 3, the second dimples 13 can be formed in the first dimples 12. The fluidity of the molten metal can vary depending on the shapes of the castings that are cast. That is, depending on the shape of the surface of the cavity, the shape of the surface that is suitable for the specific product can be selected.

If there are no large traces of treatment, etc., that were caused by machining, etc., and that disturbs the fluidity of the molten metal, the second dimples 13 need not be formed in the area of dimples D. Also, so as to remove the traces of treatment, etc., that were caused by machining, etc., the second dimples 13 can be formed in the parts outside the area of dimples D.

The surface of the cavity 11 of the die 10 after the area of dimples D is formed in it can be refined by heat-treating or treated to have nitride-coating. By such treatment, the die 10 can increase durability and can have a longer life. Also, before forming the area of dimples D the surface of the cavity 11 can be refined by heat-treatment or can be coated by nitride-treatment. But it should be noted that in such case, while forming the first dimples 12 and the second dimples 13 the conditions for forming should be observed so as not to have the coating, etc., be damaged, by using, for example, spraying materials that have round shapes.

Below an example for the steps of forming the first dimples 12 and the second dimples 13 is shown.

First the second dimples 13 are formed on all the parts where the area of dimples D is to be formed. The second dimples 13 are formed by blasting treatment of the surface of the cavity 11, using particles to be sprayed consisting of materials that have a hardness that is higher than that of the die 10. The surface roughness of the second dimples 13 should not be increased more than necessary. For example, the second dimples 13 preferably should have a surface roughness Rz (the average roughness of ten points) that is about a few μm.

To produce a surface of the cavity 11 like this, the particles to be sprayed should have the following properties. First, the particles to be sprayed should have a hardness that is greater than the hardness of the material of the die. As the material of the die, for example, SKD 61 (JIS G 4404), which is an alloy tool for hot-die that is used for casting an aluminum alloy, etc., can be named. Some of these materials have a Vickers hardness Hv as high as about 500. The particles to be sprayed that have a Vickers hardness Hv of 500 or more, or preferably 700 or more is preferably be used.

Also, to produce a surface of the cavity that has a surface roughness Rz of a few μm, the diameters of the particles to be sprayed are preferably from about 10 μm to 100 μm.

The particles to be sprayed can be of indefinite shape, spherical or of any other shape. If particles of indefinite shape are used, a grinding effect would take effect that would lower the dimensional accuracy of the die 10 because the particles would exert the grinding effect on the surface of the cavity. So, to form dimples, the particles to be sprayed preferably have spherical shapes that would have the effect of plastic deformation as their main property. If the particles to be sprayed have spherical shapes, they also give a peening effect because of the compressive residual stress they put on the cavity. So, the life of the die can be prolonged.

The particles to be sprayed that can meet the above characteristics are preferably used. For example, the iron amorphous spherical particles disclosed in the applicant's application and that were published in the gazette of patent applications, Publication Nos. JP2002-80949 (U.S. Pat. No. 4,317,930) and JP 2005-76083, can suitably be used.

The first dimples 12 that have hemispherical shapes and the openings, whose diameters are larger than those of the second dimples 13, are formed above the second dimples 13, with the first dimples 12 being intermingled with the second dimples 13. The forming of the first dimples 12 is carried out by blast-treating the part where the area of dimples D is to be formed wherein the particles to be sprayed are made of a material having a hardness that is greater than that of the material of the die 10 and diameters that are larger than those of the particles to be sprayed that are used to form the second dimples 13. The first dimples 12 are formed in such a way that the ratio of communication is 80% or more.

The first dimples 12 are preferably formed as shallow dimples of a hemispherical shape, which dimples have a ratio of the diameters of the openings to the depths, which ratio is 10 or more. To produce the dimples having such a ratio, the diameters of the particles to be sprayed are preferably from about 100 μm to 1,000 μm. Also, the ratio of area of the first dimples 12 to the area of dimples D is preferably 50-90%, more preferably about 70%.

To produce castings using the die 10, on the surface of which cavity 11 the area of dimples D is formed, first a parting agent such as boron nitride, etc., is applied to the surface of the cavity 11 of the die 10. After that, molten metal such as an aluminum alloy, etc., is poured into the cavity. Then the castings, which are solidified metals formed from the molten metal, are extruded from the die by an extrusion pin, etc.

Because the area of dimples D is formed in such a way that the second dimples 13 and the first dimples 12 are intermingled with each other, improved fluidity of the molten metal is obtained and the first dimples can effectively store the parting agent, leading to an improved release property of the surface of the cavity 11. Thus castings having no defect such as pinholes, flow marks, etc. can be manufactured. Further, if the first dimples 12 and the second dimples 13 are formed by blasting treatment, they are easily formed on the surface of the cavity of the die, which surface has a complex cavity shape.

Figure 4:
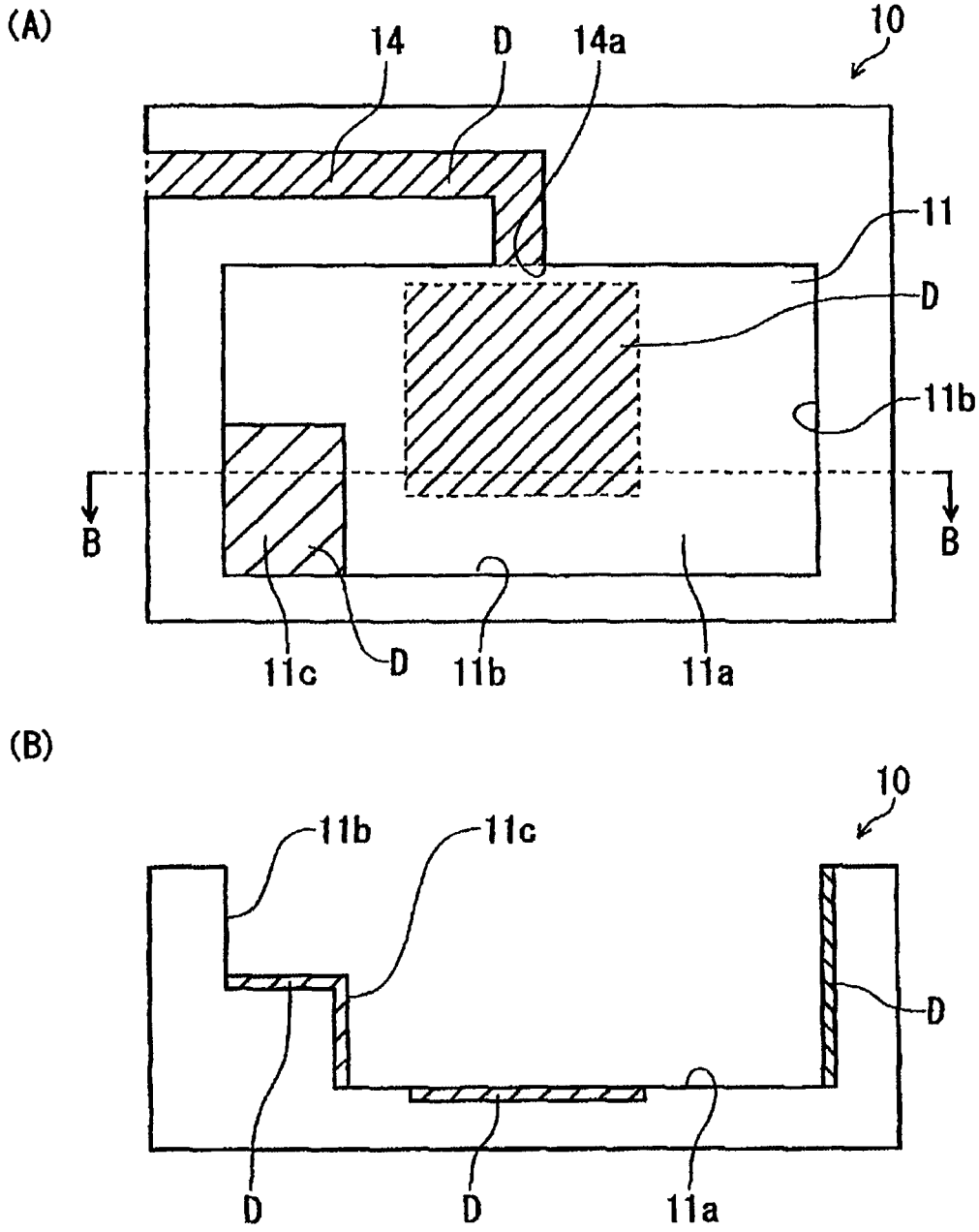
FIG. 4 is an illustration of the positions where the area of dimples is provided.

If the area of dimples D is formed by blasting treatment, it can be formed at any place where an improvement in the fluidity of the molten metal or the ease of release is required. For example, as shown in FIG. 4, in addition to the bottom part 11*a* the area of dimples D can be formed in a part such as the runner 14 through which the molten metal is poured into the cavity, on the surface of the wall that extends in an open-and-close direction to the die 10, or convexities 11*c* of the surface of the cavity 11, etc.

If the area of dimples D is formed on the runner 14, the resistance to the molten metal that passes through the runners 14 can be reduced when the molten metal is poured into the cavity. Thus the flow of the molten metal that is poured into the cavity is not hindered, improving the fluidity of the molten metal within the cavity.

The parting agent is likely to flow downward and to fall off the part of the wall 11*b*. So, the castings are likely to be affected by scoring when the castings are released from the die. By providing the area of dimples D on the part of the wall 11*b*, the above problem can be prevented from occurring.

Figure 5:
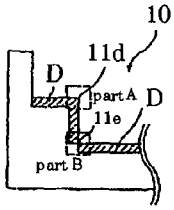
FIG. 5 is an illustration of a part of casting die where the protruded corner part (convexity) of the casting die is removed and the concavity is modified.
Figure 5:
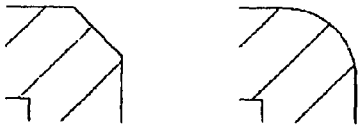
Figure 5:
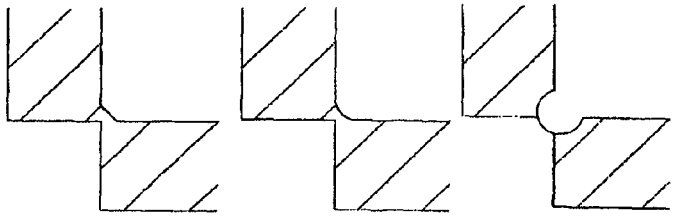

The parting agent is apt to fall off the convexities 11*c* of the surface of the cavity 11 and so the castings are likely to be affected a scoring when the castings are released from the die. Or heat cracks are likely to occur at the part that contacts the convexities of the surface of the cavity. By providing the area of dimples D on the convexities 11*c* of the surface of the cavity scoring, etc., can be suppressed. Also, as shown in FIG. 5, the protruded corner part 11*d* of the convexity is chamfered and the surface having sharp angles is removed so that the adhesion of the castings to the protruded corner part 11*d* and the phenomenon of the underfilling of the castings and heat cracks are prevented from occurring. The concavities of the surface of the cavity 11, particularly the dented corner part is likely to be affected by heat cracks. By forming concavities in the area of dimples D, the dimples are formed in the dented corner part 11*e* of the concavities. So, the surface of the cavity is formed to have a shape that disperses the stresses. So, heat cracks are prevented from occurring.

The area of dimples D can be formed only in the parts where the improved fluidity of the molten metal and the improved ease of release are required wherein the surface roughness of the castings can be minimized and the castings acquire a better appearance. For example, when the area of dimples D is formed on the bottom part 11*a*, the area of dimples D, if formed near the inlet 14*a*, can more efficiently spread the flow of the molten metal and thus can improve the fluidity of the molten metal.

The concavities and convexities formed by the first dimples 12 and the second dimples 13 in the area of dimples D can improve the fluidity of the molten metal by conserving the heat of the molten metal, for example, for the following reasons:

(1) the surface-area of the die that contacts the molten metal increases. So the heat of the molten metal is more easily transferred to the die and the die is less likely to lose heat; and (2) the airgap-layers that are formed in the larger concavities (the first dimples 12) of the concavities and convexities work to not allow the temperature of the molten metal to drop.

EXAMPLE 1

In the present example, how the ratio of communication of the first dimples affects the quality of the castings that are manufactured from a thin metal sheet casted by a casting die that has the area of dimples D formed on it is determined. The present invention is not limited to the examples described below.

The die used in the present example was made of alloy tool steel SKD61 (having a hardness of Hv470-500) and first the second dimples 13 were formed on the surface of the cavity. The second dimples 13 were formed by spraying amorphous particles "Amobeads"™ (AM-50, manufactured by Sintokogio Ltd.) having a hardness of Hv900 and a spherical shape with a diameter of 50 μm. The blasting apparatus of suction system "My Blast"™ (MY-30A, manufactured by Sintokogio Ltd.) was used as a blasting apparatus, whereby the particles were sprayed for 10 seconds at a spray-pressure of 0.3 MPa, sprayed at a distance of 100 mm, and the angle of the nozzle kept at 90 degrees.

Then the first dimples 12 were formed by changing the area-ratio and the area of dimples D was formed. In the present example, the whole surface of the cavity 11 is made into the area of dimples D. The first dimples 12 were formed by spraying a spherical-shaped steel material (SB-6PH manufactured by Sintokogio Ltd.) having a hardness of Hv700 and a diameter of 600 μm. The blasting apparatus of pressure system "My Blast"™ (MY-30AP, manufactured by Sintokogio Ltd.) was used as a blasting apparatus, whereby the particles were sprayed at a spray-pressure of 0.5 MPa, sprayed at a distance of 100 mm and the angle of the nozzle kept at 90 degrees.

In this way the area of dimples D was formed where the second dimples 13 and the first dimples 12, which first dimples 12 have a shallow hemispherical shape, were uniformly dispersed and intermingled.

The first dimples 12 had a depth of about 13 μm, and their openings had a diameter of about 240 μm and thus had a shallow hemispherical shape.

By controlling the time for spraying when forming the first dimples, the area-ratio of the first dimples to the area of dimples D can be controlled. For the purpose of comparison, five dies 10 each having a different level of the area-ratio within the range 28-97% and a die where no first dimples 12 were formed (the area-ratio is 0%) were manufactured.

The area-ratio was calculated based on the binary image that was obtained by binarization processing of the picture of the area of dimples D taken by a CCD camera. Also the ratio of communication was obtained based on the picture taken by the CCD camera by calculating the ratio of the total number of dimples to the number of dimples that were bound with the adjoining dimples, where the latter number was counted based on dimples before they were bound.

Six kinds of dies 10 were used to manufacture castings and investigated for the effect that the ratio of communication of the first dimples gives on the quality of the castings. An aluminum alloy (ADC 12: density 2.72 g/cm3) was used as the molten metal and poured into the cavity, where it had a pouring temperature of 700° C. and the temperature of the die was at 300° C. The quality of the castings was investigated after they were released from the die.

The quality of a die is evaluated by the ratio of A/B where A is the number of castings that are manufactured by the die of the present invention and that are defective, and B is the number of castings that are manufactured with a die that has no area of dimples D formed and that are defective. If the ratio is smaller, then the effect of improvement is considered to be greater. The criteria for evaluation are set as follows:

| | |
|---|---|
| ○ | A/B = less than 50% |
| Δ | A/B = 50-90% |
| X | A/B = over 90% |

Figure 6:
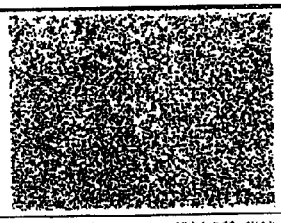
FIG. 6 gives the results of the experiments obtained based on the casting die of Example 1, showing the area-ratio of the first dimples, the ratio of communication, the planar images of the area of dimples, the qualities of the castings manufactured by various casting dies.
Figure 6:
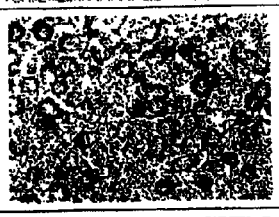
Figure 6:
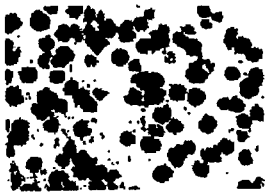
Figure 6:
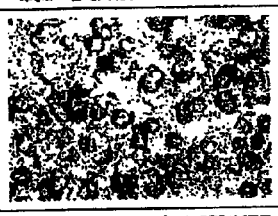
Figure 6:
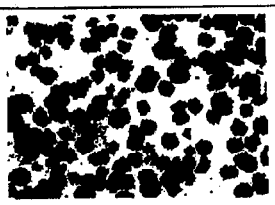
Figure 6:
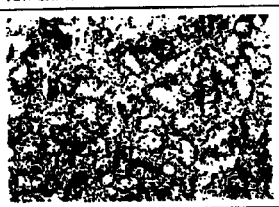
Figure 6:
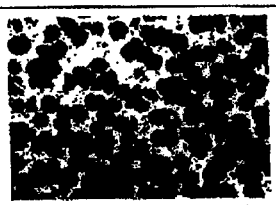
Figure 6:
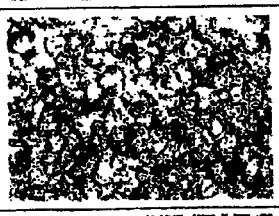
Figure 6:
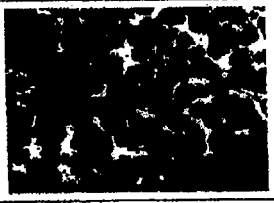
Figure 6:
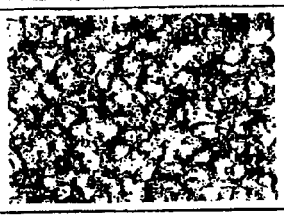
Figure 6:
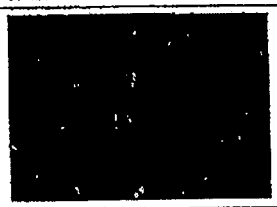

As shown in FIG. 6, if the area-ratio increased, the number of bound dimples 12*b* formed by a plurality of dimples that are bound increased and the ratio of communication increased. When the area-ratio was 50% or more, the ratio of communication became 80% or more.

The results of the evaluation of the castings show x when the area-ratio is less than 50% (0%, 28%) and show Δ when the area-ratio is above 90% (97%) where no effect of improvement was observed by forming the area of dimples D. When the area-ratio is less than 50% (0%, 28%), the defects in the castings were caused by an insufficient fluidity of the molten metal, resulting in a blister, seam, a surface fold, cold shut, penetration, etc. When the area-ratio is above 90%, the defects were caused by a decrease in the ease of release such as scoring.

When the area-ratio is 50%, 71%, or 86%, that is, when the die 10 has a ratio of communication of 80% or more, the result of the evaluation of the castings showed ○.

From this review, it was determined that by forming the first dimples 12 to have a ratio of communication of 80% or more in the area of dimples D, namely, by forming the surface of the cavity with an area-ratio of 50-90%, the fluidity of the molten metal and the ease of release improved as compared with those of the die that had the surface of the cavity treated by a conventional method.

EXAMPLE 2

The alloy tool steel SKD61 was treated by blasting treatment and the relationships of the depth to the diameter of the opening for the first dimples 12 and also the second dimples 13 were investigated. The first dimples 12 were formed by spraying three kinds of steel balls (steel shots) having an average diameter of the balls, i.e., 100, 600, and 1,000 μm, where particles to be sprayed were sprayed at a spray-pressure of 0.5 MPa, at a distance of 100 mm, and with the angle of the nozzle kept at 90 degrees. The second dimples 13 were formed by spraying particles under conditions the same as those in Example 1, the spraying particles comprising amorphous particles of a spherical form having an average size of 50, 100 μm and alumina particles of a spherical form having an average diameters of 20 μm. Table 1 shows the relationship of the depth of the dimples to the diameter of the openings of the dimples as measured from a cross sectional photo.

TABLE 1

| | | calculated from cross sectional curve (n = 3) | |
|---|---|---|---|
| | average diameter/μm | depth/μm | diameter of opening/μm |
| first dimple | 1000 | 21 | 380 |
| | 600 | 15 | 273 |
| | 100 | 4.9 | 75 |
| second dimple | 100 | 6.3 | 61 |
| | 50 | 3.9 | 35 |
| | 20 | 1.4 | 12 |

From Table 1 it is found that by using the spray particles having diameters of from 100 μm to 1,000 μm the first dimples 12 that have an opening having a diameter of 75-380 μm wide and depth of 5-21 μm were formed and by using spray particles having diameters of from 20 μm to 100 μm the second dimples that have an opening having a diameter of 12-61 μm wide and a depth of 1-7 μm were formed.

THE EFFECT OF INVENTION

The die 10 of the present invention is provided with the area of dimples D where the first dimples 12 are so formed as to be uniformly dispersed without any indication of direction. By forming the first dimples in the area of dimples D so that the ratio of communication is 80% or more, a number of bound dimples 12*b* that consist of the first dimples 12 and that form random and short flow-channels that show no indication of direction are formed uniformly and in dispersed state. The part of the molten metal that flows through the bound dimples 12*b* of the first dimples 12 and enters the above flow-channels is likely to randomly change the course of flow such that the molten metal can be uniformly dispersed within the cavity.

So, the concavities and convexities thus formed in the area of dimples D can improve the fluidity of the molten metal also by conserving the heat of the molten metal, for example, for the following reasons:

(1) the surface-area of the die that contacts the molten metal increases. So the heat of the molten metal is more easily transferred to the die and the die is less likely to lose heat; and (2) the airgap-layers that are formed in the larger concavities (the first dimples 12) of the concavities and convexities work to not allow the temperature of the molten metal to drop.

With the fluidity of the molten metal thus improved, the castings have a fewer number of defects that accompany the casting such as pinholes caused by the mixing-in of air, cold shuts, flow marks, etc.

Further, the first dimples 12 are formed in hemispherical shapes such that the parting agent that is applied to the surface of the cavity 11 when casting is performed can more easily be stored on the surface of the cavity. Also, by forming the dimples with hemispherical shapes that have no pointed corners and that are different from the shapes of the dimples that are formed by surface texturing, the castings will less likely suffer scoring, etc., when it is parted from the die. Thus the castings will be protected from damage because it can easily be released from the die.

The second dimples 13 that have openings whose diameters are smaller than those of the first dimples are formed in the area of dimples D in such a way that the second dimples 13 are intermingled with the first dimples. So, even the part in the area of dimples, in which part the first dimples are not formed, can have the traces of treatment caused by machining the surface of the cavities 11 removed and can have the surface showing no indication of direction. As a result, the first dimples 12 and the second dimples 13 can be uniformly dispersed without any indication of direction on the surface of the cavity. Also, the concavities and convexities thus formed by the first dimples 12 and the second dimples 13 can improve the fluidity of the molten metal by conserving the heat of the molten metal, for example, for the following reasons:

(1) the surface-area of the die that contacts the molten metal increases. So the heat of the molten metal is more easily transferred to the die and the die is less likely to lose heat; and (2) the airgap-layers that are formed in the larger concavities (the first dimples 12) of the concavities and convexities work to not allow the temperature of the molten metal to drop.

Also, because the part of the area of dimples where the first dimples are not formed is more likely to retain the parting agent, the peeling effect can be increased.

If the surface of the cavity is nitride-treated, the die has improved durability and a longer life.

By forming the first dimples 12 and the second dimples 13 by blasting treatment, the area of dimples D can be formed on the convexities of the surface of the cavity 11 such as on the runner 14, on the bottom part 11*a*, and on the parts of the wall 11*b*, where an improvement in the fluidity of the molten metal and the ease of release are required and where the parting agent is apt to fall off and scoring is likely to occur. So, the fluidity of the molten metal and ease of release are further improved. Also, the area of dimples D can be formed on the surface of a cavity that has a complex shape. By suitably selecting the particles to be sprayed and the conditions for spraying, the dimples having the required diameters and area-ratio can easily be formed.

OTHER EMBODIMENTS

In the embodiments of the present inventions described above, mainly the dies that are used for die casting are explained. But the dies of the present invention are not limited to those dies. The dies of the present invention can be applied to dies that are used in various casting methods, such as low-pressure casting, vacuum casting, etc.

The basic Japanese Patent Application, Nos. 2009-185341 filed Aug. 8, 2009 and 2009-269666 filed Nov. 27, 2009 are hereby incorporated in its entirety by reference in the present application.

The present invention will become more fully understood from the detailed description of this specification. However, the detailed description and the specific embodiment illustrate desired embodiments of the present invention and are described only for the purpose of explanation. Various changes and modifications will be apparent to those of ordinary skilled in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of a doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as") provided herein, is intended merely to better illuminate the invention and does not pose a limitation on the scope of the invention unless otherwise claimed.

SYMBOLS

10 die
11 surface of cavity
11*a* bottom part
11*b* part of wall
11*c* convexity
11*d* protruded corner part
11*e* dented corner part
12 first dimple
12*a* single first dimple
12*b* bound dimple
13 second dimple
14 runner
D area of dimples

The invention claimed is:

1. A casting die comprising an area of dimples where a plurality of first dimples are formed at least on a part of the surface of the cavity and/or at least on a part of a runner, in a random pattern and formed in a dispersed manner, and where the first dimples are formed in shallow hemispherical shapes and the ratio of communication that is defined by the number of first dimples that communicate with the other one or more first dimples against the total number of the first dimples is 80% or more.

2. The casting die of claim 1, wherein the first dimples have openings with diameters of 60-500 μm wide and depths of 4-30 μm and wherein the area-ratio, which is the ratio of the area of the first dimples to the area of dimples, is 50-90%.

3. The casting die of claim 1, wherein the first dimples have openings with diameters of 60-500 μm wide and depths of 4-30 μm and wherein the area-ratio, which is the ratio of the area of the first dimples to the area of dimples, is 71 to 86%.

4. The casting die of claim 1 or 3, wherein second dimples that have openings whose diameters are smaller than those of the first dimples are intermingled with the first dimples.

5. The casting die of claim 4, wherein the second dimples are formed in hemispherical shapes and have openings with diameters of 10-60 μm wide and depths of 1-7 μm.

6. The casting die of claim 1, wherein the surface of the cavity is nitride-treated.

7. The casting die of claim 1, wherein the area of dimples is provided in the runner.

8. The casting die of claim 1, wherein the area of dimples is provided at the bottom part of the surface of the cavity.

9. The casting die of claim 1, wherein the area of dimples is provided on the parts of the wall of the surface of the cavity, which parts extend in the direction in which the die opens and closes.

10. The casting die of claim 1, wherein the area of dimples is provided on convexities of the surface of the cavity.

11. The casting die of claim 10, wherein the convexities of the surface of the cavity are the protruded corner parts of the surface of the cavity.

12. The casting die of claim 1, wherein the area of dimples is provided on concavities of the surface of the cavity.

13. The casting die of claim 12, wherein the concavities of the surface of the cavity are dented corner parts of the surface of the cavity where heat cracks are likely to occur.

14. The casting die of claim 1, wherein the first dimples are formed by blasting treatment.

15. The casting die of claim 4, wherein the second dimples that are formed in the area of dimples are formed by the blasting treatment.

* * * * *